US005839600A

United States Patent [19]

Moreira et al.

[11] Patent Number: 5,839,600

[45] Date of Patent: Nov. 24, 1998

[54] PLASTIC CONTAINER FOR PRESSURIZED FLUIDS

[75] Inventors: Guilherme JoséPires Moreira; Ramon Fernandez Gandara, both of São Paulo; Mário da Fonseca, Jr., Santana do Pamalba, all of Brazil

[73] Assignee: Fibrasynthetica do Brasil Ltda., Sao Paulo, Brazil

[21] Appl. No.: 930,467

[22] PCT Filed: Dec. 18, 1996

[86] PCT No.: PCT/BR96/00067

§ 371 Date: Sep. 17, 1997

§ 102(e) Date: Sep. 17, 1997

[87] PCT Pub. No.: WO97/26481

PCT Pub. Date: Jul. 24, 1997

[30] Foreign Application Priority Data

Jan. 17, 1996 [BR] Brazil ..... 9600459

[51] Int. Cl.[6] ..... B65D 1/16

[52] U.S. Cl. ..... 220/560.04; 220/581; 220/589; 220/592

[58] Field of Search ..... 220/560.04, 581, 220/588, 589, 590, 592

[56] References Cited

U.S. PATENT DOCUMENTS

| | | | |
|---|---|---|---|
| 3,312,575 | 4/1967 | Corbin, Jr. | 220/590 |
| 3,449,182 | 6/1969 | Wiltshire | 220/590 |
| 3,843,010 | 10/1974 | Morse et al. . | |
| 4,588,106 | 5/1986 | Stark et al. | 220/590 |
| 4,690,295 | 9/1987 | Wills | 220/590 |
| 4,778,073 | 10/1988 | Ehs | 220/590 |
| 4,785,956 | 11/1988 | Kepler et al. . | |

FOREIGN PATENT DOCUMENTS 2046148.7 3/1972 Germany .

*Primary Examiner*—Joseph M. Moy
*Attorney, Agent, or Firm*—Darby & Darby

[57] ABSTRACT

A plastic container for pressurized fluids, presenting a hollow body (10) in plastic material and comprising at least one annular mounting portion (11) molded around a tubular metallic insert (20) defining the nozzle for access to the inside of the container. The tubular metallic insert (20) carries a connecting ring (40) axially compressing an annular sealing means (30) against an annular seat (26) of the insert and to which is subsequently fused the body (10) of the container through the annular mounting portion of the latter.

10 Claims, 2 Drawing Sheets

PLASTIC CONTAINER FOR PRESSURIZED FLUIDS

FIELD OF THE INVENTION

The present invention refers to a plastic container, shaped as a generally cylindrical pressure vessel or bottle, provided with a metallic nozzle and made for storing and transporting pressurized fluids, more particularly gases for home or industrial use.

BACKGROUND OF THE INVENTION

Full metal containers, built in steel or aluminum, as well as those comprising a metallic inner sealant and externally coated with reinforced plastic are known in the art.

These containers of the prior art present a metallic body incorporating a generally threaded nozzle, also in metallic material, the assembly being designed to support the high internal storage pressures of the fluid stored therein.

One of the shortcomings of these prior art metallic containers refers to the weight of their structures, requiring dimensions for storage and transportation systems which lead to a reduced net weight/gross weight ratio.

Further shortcomings of the metallic containers result from their fragmentation in cases of rupture and from a somewhat limited resistance to impact and to cryogenic situations due to the features of the metallic material.

Even in those metallic containers externally coated with reinforced plastic materials, where impact resistance is improved, the disadvantages related to excessive weight, fragmentation of the metallic sealant and their vulnerability to cryogenic shocks still persist.

On the other hand, more precisely in the field of plastic containers for fluids under low pressure, such as occurs with certain carbonated liquids, fuels and other products, constructions are known where the container nozzle may be incorporated one-piecewise to the plastic material of the body, such as in preforms of blown bottles, or may assume the shape of a metallic insert fixed to the body of the container, so as to adequately seal it or to ensure the fluid-tightness of its connection to a tubing coupled thereto.

Considering certain applications, the container requires a nozzle provided with a thread and must be structurally resistant to support torsion efforts and/or wear produced by constant operations of connection to supply or discharge tubings.

Various constructions of blown plastic vessels incorporating metallic inserts to define their input or output nozzles, to be coupled to closure caps or to various tubings of the systems to which these containers must be coupled are known.

Although presenting excellent results in low pressure fluid applications, generally under 5 bar, the known constructions for inserting metallic nozzles into these plastic containers are not capable of assuring adequate fluid-tightness when pressures in the container reach higher values, for example, over about 5 bar.

In these prior art constructions, adequate axial and rotational locking is reached, although the relative fluid-tightness is ensured only through molding of the plastic material of the container body around a portion of the surface of the insert designed to form a kind of labyrinth. These labyrinthlike mountings have proven insufficient to ensure fluid-tightness under high pressures, even when such labyrinths include elastomeric sealing rings. In these constructions, the sealing rings are barely compressed to ensure fluid-tightness under high pressures, due to the fact that the plastic material of the body is only molded around the ring.

SUMMARY OF THE INVENTION

It is a generic object of the present invention to provide a plastic container for fluids submitted to pressures over about 5 bar, provided with at least one metallic insert defining a nozzle for coupling a cap and/or an external tubing.

It is a more specific object of the present invention to provide a container construction of the type as defined above, which ensures adequate fluid-tightness between each metallic insert and the plastic bottle of the container under high internal pressures to which the latter is submitted.

The plastic container for pressurized fluids of the invention is of the type which comprises a hollow body in plastic material, with a sidewall comprising at least one mounting annular portion with its inner peripheral region fixed around a tubular metallic insert defining the nozzle for access to the inside of the container.

According to the invention, the container further comprises:

- an annular sealing means, seated against a respective external annular seat of the tubular metallic insert;
- a connecting ring in plastic material, fusible with the container body, externally mounted onto the metallic insert, so as to axially press the annular sealing means against a respective external annular seat of the tubular metallic insert;
- a retention means provided at at least one of the parts defined by the tubular metallic insert and the connecting ring and actuating against the other of said parts, so as to maintain the connecting ring axially and constantly pressing the annular sealing means with a predetermined force;
- an extension of the internal peripheral region of the annular mounting portion of the body being fused with the connecting ring already mounted onto the respective tubular metallic insert, so as to incorporate the connecting ring to the wall of the body of the container.

The constructive solution defined above is preferably applied to blown plastic containers, being however applicable to solve fluid-tightness problems of metallic inserts in molded or otherwise formed plastic containers. In general, an annular mounting portion is obtained through injection of the plastic material thereof around the tubular metallic insert, permitting the fusion thereof with the plastic material connecting ring previously mounted onto the insert and locked into a pressing position of the annular sealing means, for example an "O"-ring. When the container body is blown or molded, the wall thereof is fused with the annular mounting portion, assuring the complete formation of the body around the tubular metallic insert. The connecting ring is mounted onto the tubular metallic insert already in its final shape, permitting the maintenance of the desired pressure on the annular sealing means and, consequently, the necessary degree of fluid-tightness between the plastic material connecting ring and the tubular metallic insert. The fluid-tightness of the junction between the connecting ring and the annular mounting portion and between the latter and the wall of the container body is obtained through fusion of the plastic material, so as not to provoke any alterations in the degree of pressure of the plastic material connecting ring on the annular sealing means.

BRIEF DESCRIPTION OF THE DRAWINGS

The invention will be further described in relation to the attached drawings, wherein.

DESCRIPTION OF THE ILLUSTRATED EMBODIMENT

Figure 1:
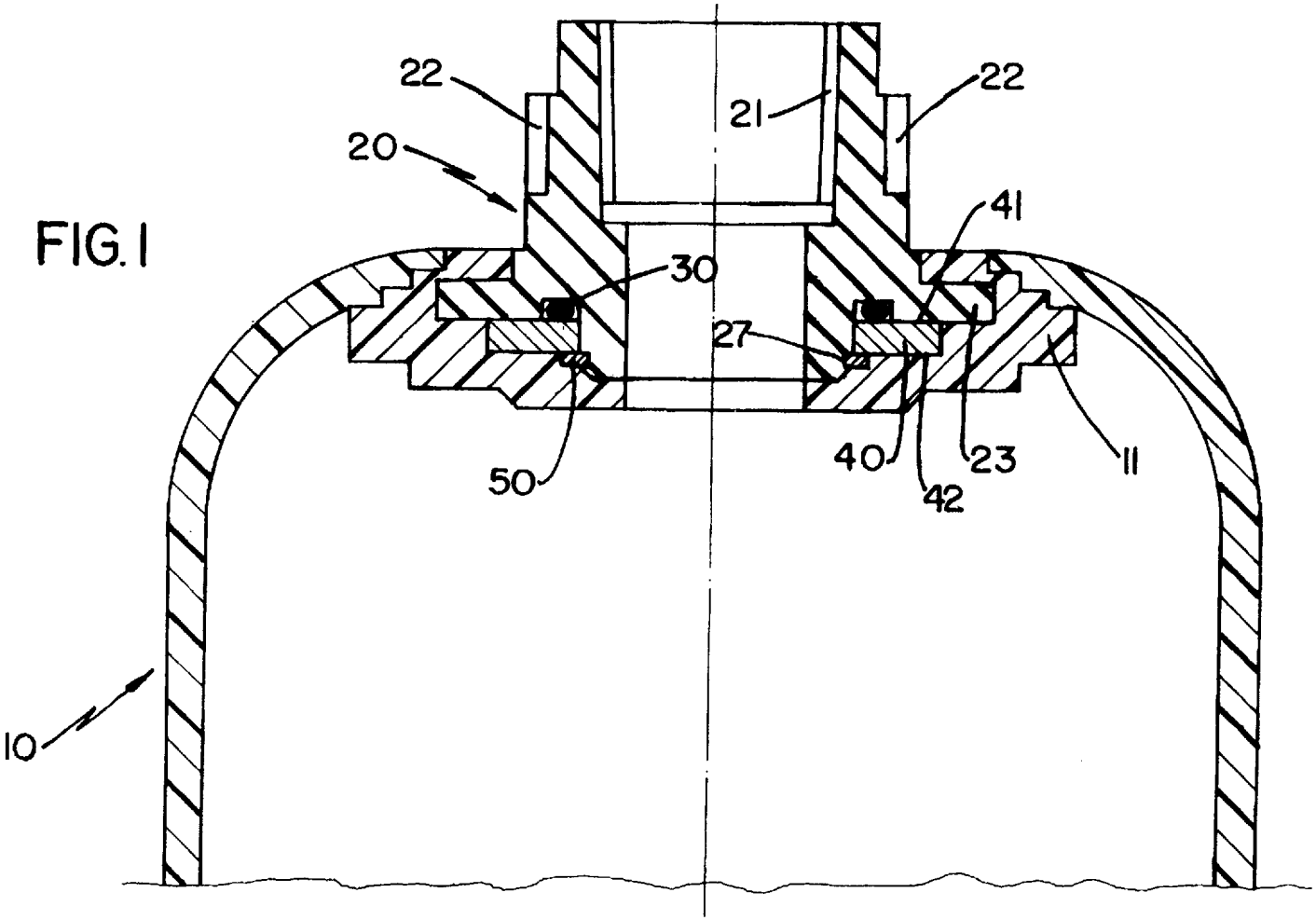
FIG. 1 represents a diametrical longitudinal sectional view of the upper portion of the body of a bottle-shaped container, the cylindrical plastic body thereof carrying an end metallic insert defining a tubular nozzle for access to the inside of the container.

According to the figures of the drawings attached, the referred plastic container assumes the shape of a cylindrical and elongated plastic bottle, of the type normally used to store and transport gases.

The illustrated container comprises a body 10 in plastic material obtained through blowing. As already mentioned previously, due to operational requirements, these containers require a nozzle defined by a respective tubular metallic insert 20 fixed to the wall of body 10 of the container.

In the example illustrated, tubular metallic insert 20 presents the shape of a tubular nozzle, provided with an internal thread 21, secant chamfers 22 on its external cylindrical surface, for adapting a tool for retention against rotation, and further a radially salient peripheral flange 23 disposed at the region of the internal end of the insert and provided with a plurality of notches 24 along the circular peripheral face thereof, defining superficial accidents.

Tubular metallic insert 20 is designed, as illustrated, so as to present an annular recess 25 at its internal end, radially internal to flange 23 and the bottom face of which defines an annular seat 26 whereon sits an annular sealing means 30 defined by an elastomeric ring with a diameter larger than the depth of annular recess 25.

On annular recess 25, a plastic material connecting ring 40, having a first end annular face 41, facing flange 23, which sits on annular sealing ring 30, is mounted. The mounting of connecting ring 40 is effected in such a way as to compress annular sealing means 30, ensuring fluid-tightness at this region of contact between conection ring 40 and metallic insert 41.

To ensure axial retention of connecting ring 40 under the condition compressing annular sealing means 30, a retention means 50 is provided which, in the illustrated embodiment, assumes the shape of an elastic ring mounted in a respective circumferential groove 27 provided externally to metallic insert 20 in a position such as to serve as a stop for an end annular face 42 of the connecting ring, opposed to face 41 seated against flange 23. It should be understood that retention means 50 may present different constructions, as long as it ensures axial retention of connecting ring 40 in a position such as to compress annular sealing means 30.

However, other mountings between connecting ring 40 and the respective metallic insert 20 may be provided. For example, the axial retention of the connecting ring could be obtained through threads provided on both parts or even through screws.

Figure 2:
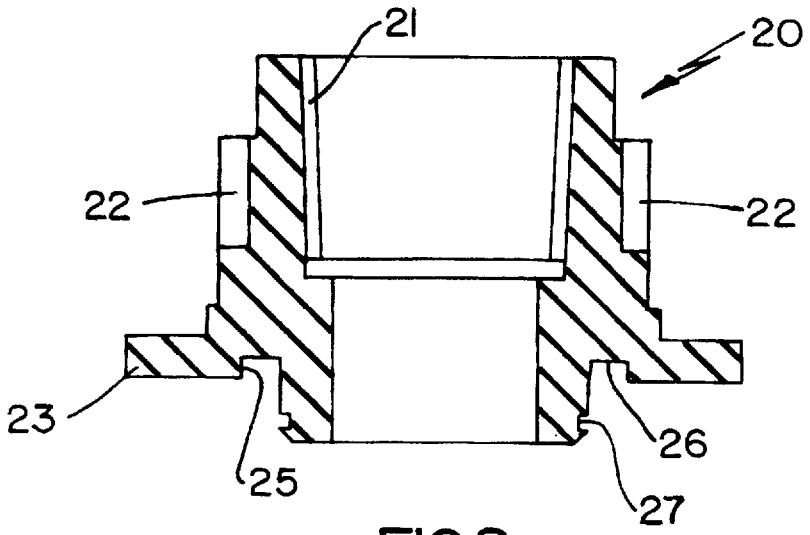
FIG. 2 represents a diametrical sectional view of the tubular insert illustrated in FIG. 1.
Figure 3:
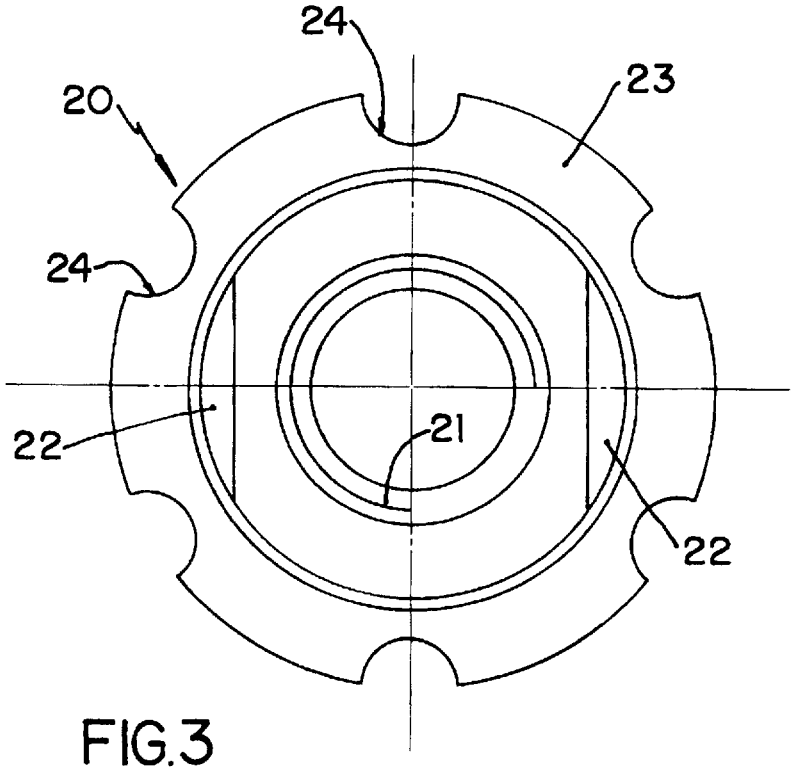
FIG. 3 represents an end view of the tubular nozzle illustrated in FIG. 1.

According to the construction represented in FIG. 2, after the mounting of connecting ring 40 with metallic insert 20, this assembly receives an injection of an annular mounting portion 11 of body 10, in plastic material compatible with that of connecting ring 40. During the injection thereof, annular mounting portion 11 encases the external region of tubular metallic insert 20 provided with flange 23 and with connecting ring 40, fusing itself with the latter whereby to form therewith a single piece. The annular mounting portion thereby becomes axially, radially and rotationally locked against tubular metallic insert 20 covering the internal end face thereof and part of the longitudinal extension of the external face where flange 23 is located. The interface between annular mounting portion 11 and tubular metallic insert 20 defines a labyrinthlike junction, communicating the inside of the container with the outside thereof and provided with the annular sealing means 30 which ensures, in the compressed condition thereof, the fluid-tightness of the junction under high pressures within the container. In the illustrated constructive example, body 10 of the container may be obtained through blowing of a parison over the metallic insert which defines the tubular nozzle for access to the inside of the container. Through blowing, the plastic body 10 is fused with annular mounting portion 11, as illustrated in FIG. 1, completing the container. It should be understood that the illustrated junction system between body 10 and annular mounting portion 11 is only exemplary of a possible constructive solution, since body 10 may also be extended until it directly encases the side surface of insert 20.

Depending on the application foreseen for the container, it is possible to obtain body 10 thereof through molding processes other than blow molding and without using the annular mounting portion 11 previously injected around tubular metallic insert 20. In this case, body 10 would have an annular mounting portion 11 formed simultaneously and together with the rest of the container wall and fused with connecting ring 40.

What is claimed is:

1. A plastic container for pressurized fluids, presenting a hollow body (10) in plastic material, with the side wall thereof comprising at least one annular mounting portion (11) with the internal peripheral region thereof fixed around a nozzle shaped as a tubular metallic insert (20), characterized in comprising:

an annular sealing means (30), seated against a respective annular external seat (26) of the metallic tubular insert (20);

a connecting ring (40) in plastic material fusible with the body (10) of the container, mounted externally to the tubular metallic insert (20), so as to axially press the annular sealing means (30) against a respective annular external seat (26) of the tubular metallic insert (20);

a retention means (50) provided with at least one of the parts defined by the tubular metallic insert (20) and connecting ring (40) and acting against the other of said parts, to maintain the connecting ring (40) pressing the annular sealing means (30) axially and constantly with a predetermined force;

an extension of the peripheral internal region of the annular mounting portion (11) of the body (10) being fused with the connecting ring (40) already mounted on the respective tubular metallic insert (20), so as to incorporate the connecting ring (40) to the wall of the body (10) of the container.

2. The container of claim 1, characterized in that the annular external seat (26) of the tubular metallic insert (20) is defined at the end of the latter facing the inside of the body (10) of the container.

3. The container of claim 2, characterized in that the annular external seat (26) is defined by the bottom face of an annular recess (25) provided at the end of the tubular metallic insert (20) facing the inside of the body (10) of the container.

4. The container of any one of claims 1,2 or 3, characterized in that the tubular metallic insert (20) incorporates, at the end region thereof facing the inside of the body (10) of the container, a radially salient peripheral flange (23), provided with a plurality of superficial accidents (24) on the peripheral circular face therof.

5. The container of claim 4, characterized in that the connecting ring (40) is mounted against an axially external face of the flange (23).

6. The container of claim 5, characterized in that the retention means (50) is defined by an elastic ring mounted in a circumferential groove (27) internal to the metallic insert (20) and seated against an end annular face (42) of the connecting ring (40), opposed to the face (41) seated on the annular sealing means (30) and on the flange (23).

7. The container of claim 1, characterized in that the annular sealing means (30) is defined by an elastomeric ring.

8. The container of claim 1, characterized in that the annular mounting portion (11) is an element injected around the tubular metallic insert (20), so as to have its internal peripheral region fused with the connection ring (40) before the formation of the body (10) of the container.

9. The container of claim 8, characterized in that the body (10) of the container is fused with the annular mounting portion (11) already fixed around the metallic insert (20).

10. The container of claim 1, characterized in that the annular mounting portion (11) is formed in a single piece with the body (10) of the container and fused with the connecting ring (40).

* * * * *